United States Patent [19]

Steinhardt

[11] Patent Number: 5,059,060

[45] Date of Patent: Oct. 22, 1991

[54] TRAFFIC CONTROL SYSTEM

[76] Inventor: Howard Steinhardt, 251 E. 51st St., New York, N.Y. 10022

[21] Appl. No.: 545,923

[22] Filed: Jun. 28, 1990

[51] Int. Cl.[5] ..... E01F 9/00

[52] U.S. Cl. ..... 404/11; 404/9

[58] Field of Search ..... 404/11, 6, 9, 10, 12, 404/15

[56] References Cited

U.S. PATENT DOCUMENTS

| | | | |
|---|---|---|---|
| 1,845,774 | 2/1932 | Wilson | 404/11 |
| 2,176,285 | 10/1939 | Whiting | 404/11 |
| 2,308,525 | 1/1943 | Lowe | 404/11 |
| 2,519,145 | 8/1950 | Manly | 404/11 |
| 4,012,156 | 3/1977 | Turner et al. | 404/15 |
| 4,140,418 | 2/1979 | Holley | 404/11 |
| 4,234,264 | 11/1980 | Baldi | 404/11 |
| 4,342,525 | 8/1982 | Mastronuzzi, Jr. | 404/6 |
| 4,367,975 | 1/1983 | Tyers | 404/11 X |
| 4,737,049 | 4/1988 | Callhen | 404/11 |
| 4,848,958 | 7/1989 | Sheldon | 404/11 |

FOREIGN PATENT DOCUMENTS

| | | | |
|---|---|---|---|
| 1164452 | 3/1964 | Fed. Rep. of Germany | 404/11 |

OTHER PUBLICATIONS

Technical Council Info Report; Road Bumps—Appropriate for Use on Public Streets; by ITE Technical Council Committee 5B-15; ITE Journal; Nov. 1986.

Recommended Guidelines for the Design and Application of Speed Bumps; third draft; ITE Special Task Force; Mar. 9, 1990.

*Primary Examiner*—Ramon S. Britts

*Assistant Examiner*—Gay Ann Spahn

*Attorney, Agent, or Firm*—Schweitzer Cornman & Gross

[57] ABSTRACT

A traffic control apparatus for use in combination with a roadway having a paved surface, comprising an elongated housing structure disposed beneath said roadway; the major axis of said housing being perpendicular to the direction of traffic on said roadway; said housing having an upper wall disposed generally in the plane of said paved surface; said upper wall defining a generally rectangular opening; speed bump means disposed in said housing for selective movement relative thereto between predetermined inactive and active positions; said speed bump means being elongated, and substantially the length of said opening; said speed bump means having a flat surface portion adapted to close said opening and to bridge the width of said opening in the plane of the paved surface; said speed bump means having a generally cylindrical portion adapted to close said opening and to bridge the width of said opening with a projection above the plane of the paved surface; actuation means for selectively moving said speed bump means between said active and inactive positions.

9 Claims, 2 Drawing Sheets

TRAFFIC CONTROL SYSTEM

BACKGROUND AND SUMMARY OF THE PRESENT INVENTION

Systems and apparatus for controlling the flow of traffic are well known to the highway engineering arts. Prominent among the apparatus and devices employed in reducing the speed of traffic in general and individual speeding automobiles and vehicles in particular are changeable traffic lights or flashing lights which are installed at intersections or dangerous locations on roadways; appropriate signage placed at the approaches to intersections and the approaches to dangerous locations which signage may also be combined with flashing lights; and apparatus or devices such as "speed bumps" or "speed breakers" in the form of projections permanently built into the otherwise flat surface of a roadway to provide a projection which will create a bump which will tend to create discomfort or damage to a vehicle traversing the bump at an unduly high speed.

The present invention is in the nature of new and improved "speed bump" or "speed breaker" equipment which provides advantages not heretofore available in the development of this type of device as well as overcoming certain shortcomings present in existing speed bumps and speed breakers.

Specifically the present invention is directed to a traffic control apparatus which may be installed in roadway surfaces to provide a selectively operable speed bump, i.e., a bump which may be activated into a traffic-slowing position in which it projects above the surface of the roadway or which may be selectively rotated into an inactive position in which the roadway remains flat in the area of the inactivated speed bump. The apparatus of the invention is in the form of an elongated steel roll of approximately 18" diameter which roll has two flattened portions formed on its periphery between its normal rounded or cylindrical peripheral portions. The roller is mounted in a housing in a manner whereby the curved cylindrical portions project above the upper wall of the housing, which upper wall is installed in a generally coplanar relation with the roadway in which the traffic control apparatus is to be mounted. An activating control is associated with the roller so that it may be rotated from an active position in which the curved speed bump portions project above the roadway surface into an inactive position in which the flat surface is generally coplanar with the roadway and the upper wall portions of the housing.

As a more specific aspect of the traffic control apparatus of the present invention, appropriate signage such as a flashing light or other warning device may be mounted proximately of the housing upstream thereof with regard to traffic flow thereover to provide warning to approaching motor vehicles of the activation of the speed bump. When the speed bump roller is moved into an active position in which the contoured surface projects above the highway, the warning signage is also activated to provide motorists with information of the activation in order that the speed of vehicles approaching the activated speed bump may be safely reduced.

For a more complete understanding of the principles and details of construction of the apparatus of the present invention as well as other of its attendant advantages, reference should be made to the accompanying drawings taken in conjunction with the following detailed description.

DETAILED DESCRIPTION OF THE INVENTION

Figure 1:
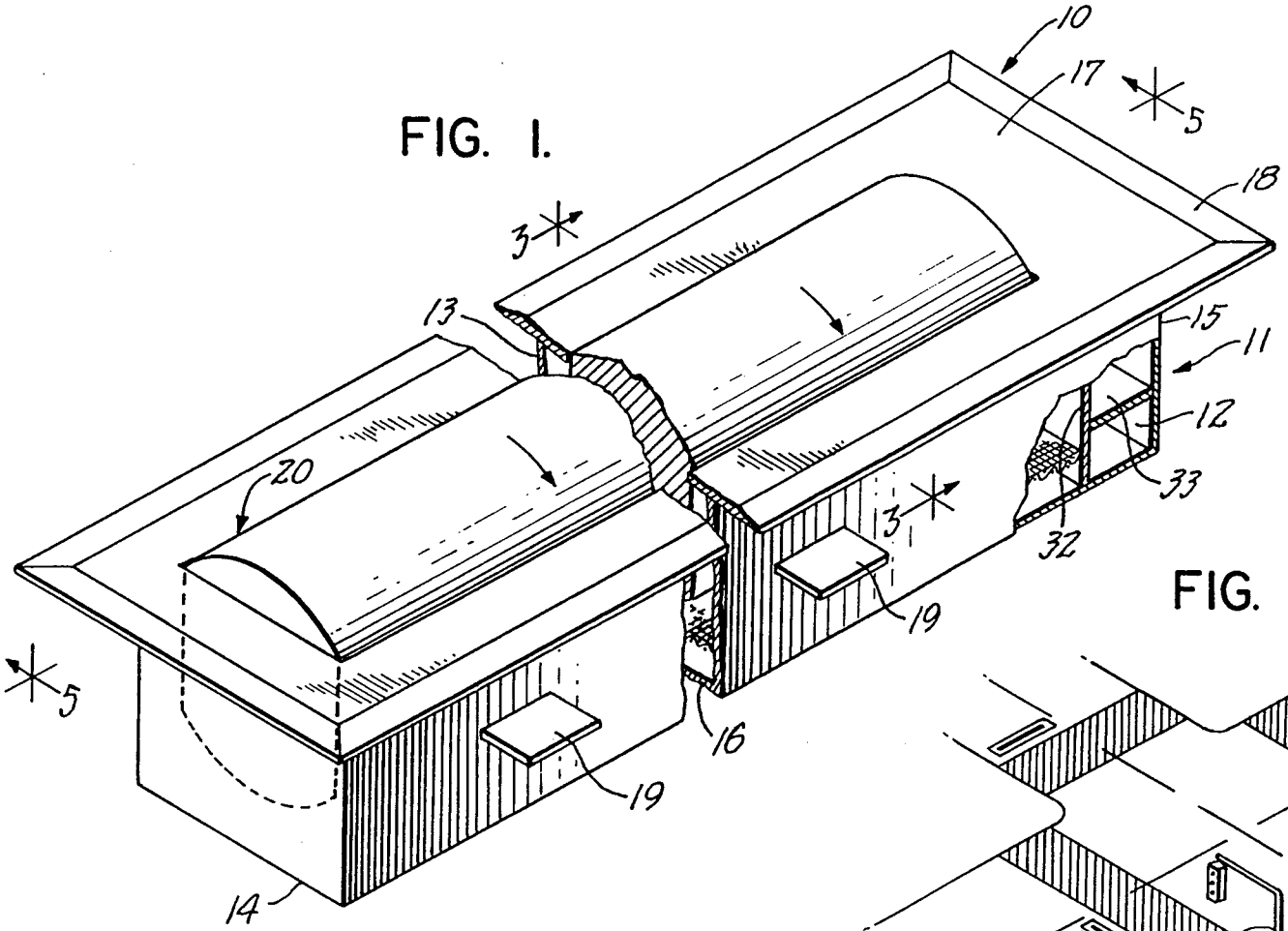
FIG. 1 is a perspective view of the traffic control apparatus of the present invention showing the speed bump means in an active position.
Figure 5:
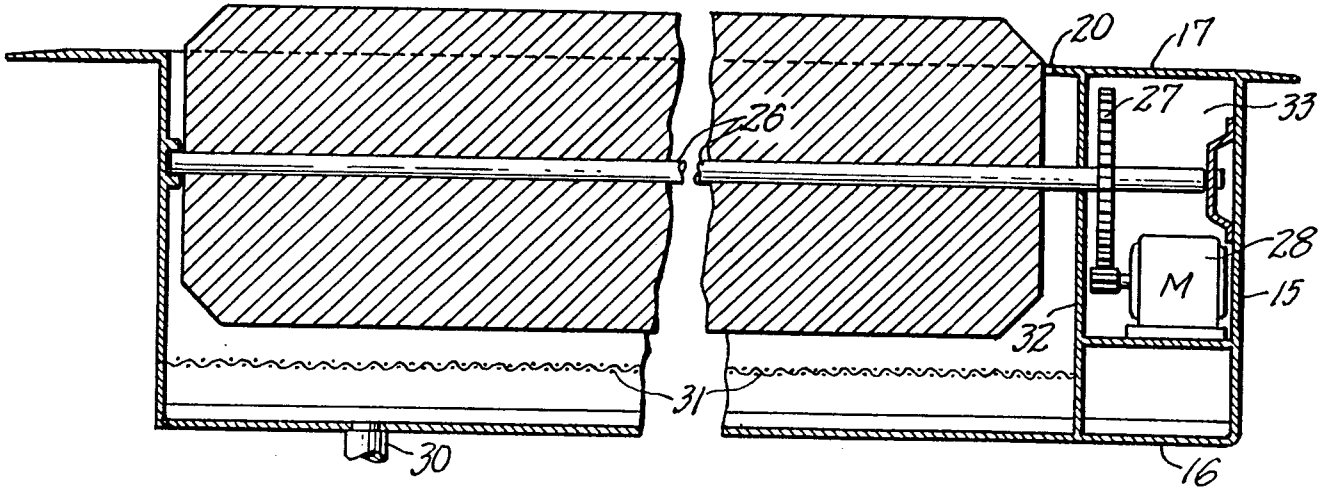
FIG. 5 is a cross-sectional view taken along line 5—5 of FIG. 1 showing drive apparatus for rotating the roller between active and inactive positions.

Referring now to FIG. 1, the traffic control apparatus 10 of the present invention includes a housing 11 comprising elongated front and rear walls 12, 13; end walls 14, 15; a bottom wall 16; and an upper wall 17 circumscribed by an outer mounting flange 18. An anchor bar 19 is provided to secure the housing to the roadway pavement. An inner wall 32 parallel with end wall 15 forms a compartment 33 for a drive mechanism for the speed bump roller 21 (FIG. 5).

Figure 2:
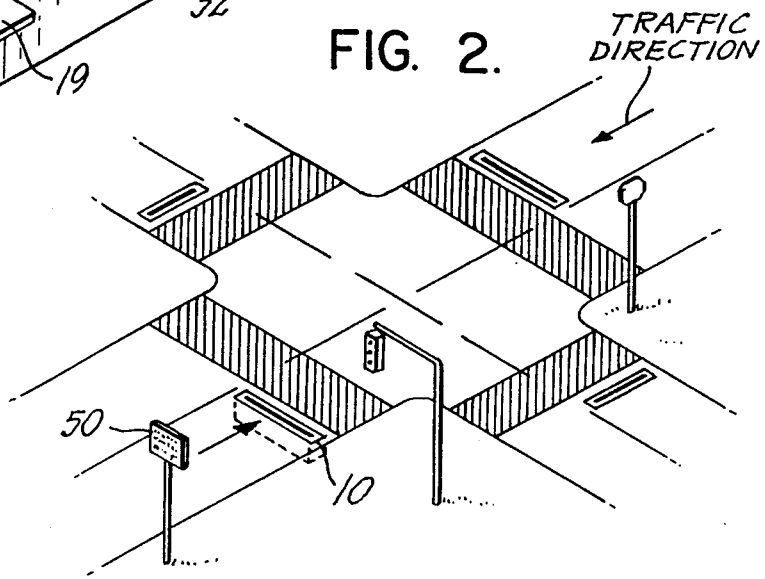
FIG. 2 is a schematic view of a traffic intersection having four lanes of traffic in which traffic control apparatus units of the present invention are installed.
Figure 4:
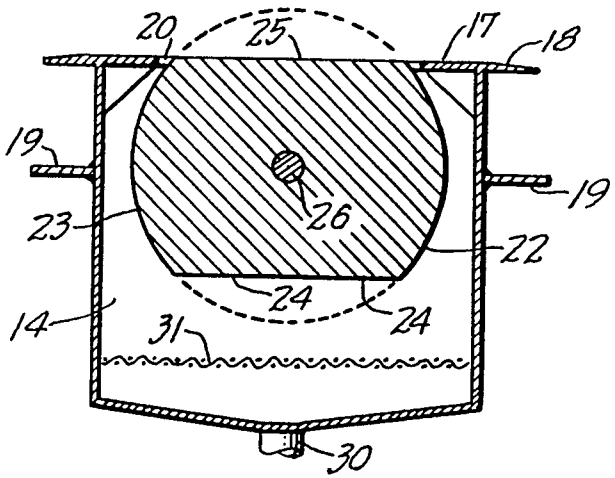
FIG. 4 is a cross-sectional view showing the new and improved speed bump roller in an inactive position.
Figure 3:
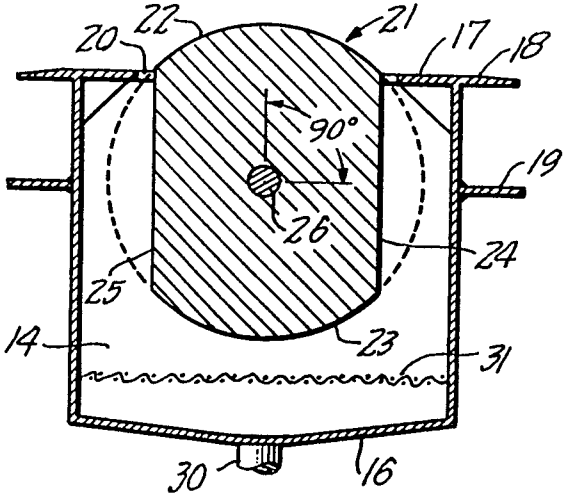
FIG. 3 is a cross-sectional view taken along lines 3—3 of FIG. 1 showing the speed bump roller of the invention in an active position.

An elongated rectangular opening 20 is formed in the top wall 17, the long dimension of the opening 20 being generally sufficient to traverse at least one lane of traffic. As shown in FIG. 2 a plurality of the traffic control units 10 of the present invention may be installed in each of the lanes of traffic approaching an intersection. The length of the opening 20 is greater than the typical width of a motor vehicle traversing the apparatus as will be understood. The width of the opening 20 will be advantageously approximately 15". With a 15" wide opening, an elongated speed bump roller 21 is provided in the form of a steel cylinder having an 18" diameter and a length of approximately ten feet, the width of a traffic lane. The roller 21 has opposite curved portions 22, 23 between which are formed flat portions 24, 25 as shown best in FIGS. 3 and 4.

In accordance with the invention, the speed bump roller 21 is mounted on a shaft 26 for rotation about its longitudinal axis. As shown in FIG. 5 an appropriate drive gear 27 is mounted at one end of the shaft and engages a drive mechanism 28 (shown schematically) which is driven by a motor M to rotate the shaft 26 and the speed bump roller 21 mounted thereon 90 in a clockwise direction between an active position shown in FIG. 3 in which the arcuate surfaces 22 project above the upper wall 17 of the housing and an inactive position shown in FIG. 4 in which the flat surface 24 is in an coplanar relation with the upper wall 17 and effectively bridges the gap between the opposite edges of the opening 20 as shown.

The bottom wall 16 of the housing advantageously includes a drain 30 which may be connected to a sewer to permit accumulated highway runoff to be evacuated from the housing. The drain 30 is covered by a spaced screen 31 to prevent clogging by leaves and other litter which may accumulate in the housing. The outer surfaces 21, 23, 24, 25 of the speed bump roller may be provided by machining or otherwise with a textured, nonslip surface to provide traction to motor vehicles traversing the traffic control apparatus shown and described herein.

It will be understood that the employment of a speed bump apparatus of the type described herein enables a speed bump traffic-slowing device to be employed selectively in areas when it is desired to slow traffic at only certain times of the day. It will also be appreciated that the device of the present invention may be deactivated when traffic or weather conditions dictate that the speed bump be removed from operation, such as when the weather itself will slow traffic or when the roadway in which the device is installed requires snowplowing, etc.

As a specific aspect of the present invention the circuitry used to activate the motor which drives the mechanism 28 to activate the speed bump may associated therewith also energizes a flashing sign 50 (FIG. 2) which is located ahead of the traffic control apparatus in the direction of traffic flow so as to provide warning to motorists of the activation of the speed bump or speed breaker of the present invention.

While the present invention has been described by reference to a particular preferred embodiment, it is to be understood that this is for purposes of illustration only and that variations thereof will be apparent to those skilled in the art. Accordingly, the scope of the invention is to be limited by the following appended claims.

I claim:

1. A traffic control apparatus for use in combination with a roadway having a paved surface, comprising (a) an elongated housing structure disposed beneath said roadway; the major axis of said housing being perpendicular to the direction of traffic on said roadway;

(b) said housing having an upper wall disposed generally in the plane of said paved surface;

(c) said upper wall defining a generally rectangular opening;

(d) speed bump means on a shaft disposed in said housing for selective movement relative thereto between predetermined inactive and active positions;

(e) said speed bump means being elongated, and substantially the length of said opening;

(f) said speed bump means having a flat surface portion adapted to close said opening and to bridge the width of said opening in the plane of the paved surface;

(g) said speed bump means having a generally cylindrical portion adapted to close said opening and to bridge the width of said opening with a non-depressible projection above the plane of the paved surface;

(h) actuation means for selectively rotating said speed bump means between said active and inactive positions.

2. The traffic control apparatus of claim 1, in which (a) speed bump means is rotatable 90 degrees between said active and inactive position.

3. The traffic control apparatus of claim 1, in which (a) said actuation means includes an electric motor;

(b) a driving gear train means transmits torque from said motor to said speed bump means through said shaft.

4. The traffic control apparatus of claim 1, in which (a) a non-slip surface is formed on the periphery of said speed bump means.

5. The traffic control apparatus of claim 1, in which (a) a drainage means is included within said housing;

(b) a screen means is juxtaposed with said drainage means.

6. The traffic control apparatus of claim 1, which further includes (a) selectively actuatable warning signal means;

(b) said signal means providing warning signals when said speed bump means is in said active position.

7. The traffic control apparatus of claim 6, which further includes (a) a control means associated with said motor and said signal means to energize said signal means whenever said motor has rotated said speed bump means into an active position and to de-energize said signal means whenever said motor has rotated said speed bump means into an inactive position.

8. The traffic control apparatus of claim 7, in which (a) said control means are actuatable remotely.

9. The traffic control apparatus of claim 2, in which (a) the width of said opening is approximately 15 inches;

(b) the diameter of said roller is approximately 18 inches;

(c) the width of said flat portions is approximately 15 inches;

(d) said cylindrical portions have profiles defined by arcs subtended by a 15 inch square.

* * * * *